US009984601B2

(12) United States Patent
Cui et al.

(10) Patent No.: US 9,984,601 B2
(45) Date of Patent: May 29, 2018

(54) REPAIRING SYSTEM AND REPAIRING METHOD FOR A CABC MODULE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Zhijia Cui, Beijing (CN); Shuai Xu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days. days.

(21) Appl. No.: 15/247,994

(22) Filed: Aug. 26, 2016

(65) Prior Publication Data

US 2017/0199239 A1 Jul. 13, 2017

(30) Foreign Application Priority Data

Jan. 7, 2016 (CN) ..... 2016 1 0010101

(51) Int. Cl.
*G09F 9/35* (2006.01)

(52) U.S. Cl.
CPC ..... *G09F 9/35* (2013.01)

(58) Field of Classification Search
CPC ..... G01R 31/3187
USPC ..... 714/733, 736, 738
See application file for complete search history.

(56) References Cited

U.S. PATENT DOCUMENTS

| | | | | |
|---|---|---|---|---|
| 9,552,781 | B2 * | 1/2017 | Takagi | G09G 3/36 |
| 2014/0267466 | A1 * | 9/2014 | Takagi | G09G 3/36 345/691 |
| 2015/0206483 | A1 * | 7/2015 | Hesselmark | G09G 3/3406 345/207 |
| 2016/0125788 | A1 * | 5/2016 | Zhang | G09G 3/2044 345/596 |
| 2016/0284279 | A1 * | 9/2016 | Li | G09G 3/3406 |

* cited by examiner

*Primary Examiner* — Fritz Alphonse
(74) *Attorney, Agent, or Firm* — Ladas & Parry LLP

(57) ABSTRACT

Embodiments of the present disclosure provide a repairing system and a repairing method for a CABC module. The system comprising: a CABC module that includes a first register and a second register; an initial value register configured to input a check value or an initial value to the first register; a first logic circuit, a second logic circuit, a third logic circuit and a fourth logic circuit.

14 Claims, 6 Drawing Sheets

Repairing system A for a CABC module

Repairing system A for a CABC module

REPAIRING SYSTEM AND REPAIRING METHOD FOR A CABC MODULE

TECHNICAL FIELD

The present disclosure relates to a repairing system and a repairing method for a CABC module.

BACKGROUND

The CABC (Content Adaptive Backlight Control) module is a dynamic backlight adjustment module in a liquid crystal display, a PWM waveform outputted by the CABC module is communicated to a backlight driver circuit, since a voltage of the backlight driver circuit is about 20V, an operating voltage of the CABC module is 3.3V, there is a risk of burning the CABC module due to a large external voltage. In the prior art, when logic circuits in the CABC module have a dysfunction, the CABC module cannot continue to operate properly. Alternatively, when only a small part of logic circuits in the CABC module has a dysfunction, impact on the circuit is relatively small, but the chance for errors of such CABC module whose small part has a dysfunction increases.

When the CABC module ceases its functions due to abnormality of the logic circuits, such manner reduces utilization of the circuit. On the other hand, if continuing to use the CABC module whose small part of logic circuits has a dysfunction, it increases the CABC module's chance for errors when outputting the PWM waveform for controlling backlight brightness.

SUMMARY

For the sake of repairing the CABC module having only one abnormal bit in a memory and enabling it to operate normally, embodiments of the present disclosure provide a repairing system and a repairing method for a CABC module.

In a first aspect, an embodiment of the present disclosure provides a repairing system for a CABC module, said repairing system comprising:

a CABC module that includes a first register and a second register;

an initial value register configured to input a check value or an initial value to the first register;

a first logic circuit configured to perform a logic operation on a check value of a bit stored in the first register so as to obtain an intermediate value, so that a value corresponding to an abnormal bit in the first register as contained in the intermediate value is different than a value corresponding to a normal bit;

a second logic circuit configured to perform a logic operation on the intermediate value and an initial value of a corresponding bit in the initial register so as to obtain a first correction value, a value corresponding to an abnormal bit as contained in the first correction value being equal to a value corresponding to an abnormal bit as contained in the initial value;

a third logic circuit configured to perform a logic operation on the intermediate value after an NOT logic operation and an initial value of a corresponding bit in the first register so as to obtain a second correction value, a value corresponding to a normal bit as contained in the second correction value being equal to a value corresponding to a normal bit as contained in the initial value; and a fourth logic circuit configured to perform a logic operation on the first correction value and the second correction value, so as to obtain a result which would have been obtained by inputting an initial value into the first register having no failure, as an input of the second register.

Optionally, the first logic circuit comprises N numbers of Exclusive-NOR gates and N numbers of First AND gates, wherein an (N−1)-th Exclusive-NOR gate performs an Exclusive-NOR operation on check values of an N-th bit and an (N−1)-th bit stored in the first register, an N-th Exclusive-NOR gate performs an Exclusive-NOR operation on values of the N-th bit and a first bit stored in the first register, an N-th First AND gate performs an AND operation on outputs of the (N−1)-th Exclusive-NOR gate and the N-th Exclusive-NOR gate, a first First AND gate performs an AND operation on outputs of the N-th Exclusive-NOR gate and a first Exclusive-NOR gate, so as to obtain the intermediate value;

N is a natural number larger than or equal to 2.

Optionally, the first logic circuit comprises N numbers of Inclusive-OR gates and N numbers of First AND gates, wherein an (N−1)-th Inclusive-OR gate performs an Inclusive-OR operation on check values of an N-th bit and an (N−1)-th bit stored in the first register, an N-th Inclusive-OR gate performs an Inclusive-OR operation on values of the N-th bit and a first bit stored in the first register, an N-th First AND gate performs an AND operation on outputs of the (N−1)-th Inclusive-OR gate and the N-th Inclusive-OR gate, a first First AND gate performs an AND operation on outputs of the N-th Inclusive-OR gate and a first Inclusive-OR gate, so as to obtain the intermediate value;

N is a natural number greater than or equal to 2.

Optionally, the first logic circuit comprises N numbers of XOR gates and N numbers of NOR gates, wherein an (N−1)-th XOR gate performs an XOR operation on check values of an N-th bit and an (N−1)-th bit stored in the first register, an N-th XOR gate performs an XOR operation on values of the N-th bit and a first bit stored in the first register, an N-th NOR gate performs an NOR operation on outputs of the (N−1)-th XOR gate and the N-th XOR gate, a first NOR gate performs an NOR operation on outputs of the N-th XOR gate and a first XOR gate, so as to obtain the intermediate value;

N is a natural number greater than or equal to 2.

Optionally, the second logic circuit comprises N numbers of Second AND gates;

wherein an N-th Second AND gate performs an AND operation on the intermediate value and an initial value of an N-th bit as correspondingly stored in the initial value register, to obtain the first correction value;

the third logic circuit comprises N numbers of First NOT gates and N numbers of Third AND gates;

an N-th First NOT gate performs an NOT operation on each bit of the intermediate value;

an N-th Third AND gate performs an AND operation on an output of an N-th First NOT gate and a value of an N-th bit as stored in the first register, so as to obtain the second correction value;

the fourth logic circuit comprises N numbers of OR gates;

an N-th OR gate performs an OR operation on outputs of the N-th Second AND gate and the N-th Third AND gate;

N is a natural number greater than or equal to 2.

Optionally, the second logic circuit comprising N numbers of Second NOT gates and N numbers of Second OR gates;

an N-th Second NOT gate performs an NOT operation on each bit of the intermediate value;

an N-th Second OR gate performs an OR operation on an output of the N-th Second NOT gate and an initial value of an N-th bit as correspondingly stored in the initial value register;

the third logic circuit comprises N numbers of Third OR gates;

an N-th Third OR gate performs an OR operation on the intermediate value and a value of an N-th bit as correspondingly stored in the first register;

the fourth logic circuit comprises N numbers of Fourth AND gates;

an N-th Fourth AND gate performs an AND operation on outputs of the N-th Second OR gate and the N-th Third AND gate;

wherein N is a natural number greater than or equal to 2.

Optionally, the repairing system for a CABC module further comprises a detection module and a counting module;

the detection module being configured to detect whether an N-th bit in the first register is abnormal;

the counting module being configured to obtain a total number of bits that are abnormal in the first register;

wherein if no abnormal bit appears in the first register, outputs of bits in the first register are regarded as inputs of bits corresponding thereto in the second register;

if a plurality of abnormal bits appear in the first register, the CABC module is closed.

In a second aspect, an embodiment of the present disclosure further provides another repairing system for a CABC module, said repairing system comprising:

a CABC module that includes a first register and a second register;

an initial value register configured to input a check value or an initial value to the first register;

a first logic circuit configured to perform a logic operation on a check value of a bit stored in the first register so as to obtain an intermediate value, so that a value corresponding to an abnormal bit in the first register as contained in the intermediate value is different than a value corresponding to a normal bit;

a second logic circuit configured to perform a logic operation on the intermediate value after an NOT logic operation and an initial value of a corresponding bit in the initial register so as to obtain a first correction value, a value corresponding to an abnormal bit as contained in the first correction value being equal to a value corresponding to an abnormal bit as contained in the initial value;

a third logic circuit configured to perform a logic operation on the intermediate value and an initial value of a corresponding bit in the first register so as to obtain a second correction value, a value corresponding to a normal bit as contained in the second correction value being equal to a value corresponding to a normal bit as contained in the initial value; and a fourth logic circuit configured to perform a logic operation on the first correction value and the second correction value, so as to obtain a result which would have been obtained by inputting an initial value into the first register having no failure, as an input of the second register.

Optionally, the first logic circuit comprises N numbers of Inclusive-NOR gates and N numbers of First AND gates, wherein an (N−1)-th Inclusive-NOR gate performs an Inclusive-NOR operation on check values of an N-th bit and an (N−1)-th bit stored in the first register, an N-th Inclusive-NOR gate performs an Inclusive-NOR operation on values of the N-th bit and a first bit stored in the first register, an N-th First AND gate performs an AND operation on outputs of the (N−1)-th Inclusive-NOR gate and the N-th Exclusive-NOR gate, a first First AND gate performs an AND operation on outputs of the N-th Inclusive-NOR gate and a first Inclusive-NOR gate, so as to obtain the intermediate value;

N is a natural number larger than or equal to 2.

Optionally, the first logic circuit comprises N numbers of XOR gates and N numbers of First OR gates, wherein an (N−1)-th XOR gate performs an XOR operation on check values of an N-th bit and an (N−1)-th bit stored in the first register, an N-th XOR gate performs an XOR operation on values of the N-th bit and a first bit stored in the first register, an N-th First OR gate performs an OR operation on outputs of the (N−1)-th XOR gate and the N-th XOR gate, a first First OR gate performs an OR operation on outputs of the N-th XOR gate and a first XOR gate, so as to obtain the intermediate value;

N is a natural number greater than or equal to 2.

Optionally, the first logic circuit comprises N numbers of Inclusive-OR gates and N numbers of First NOR gates, wherein an (N−1)-th Inclusive-OR gate performs an Inclusive-OR operation on check values of an N-th bit and an (N−1)-th bit stored in the first register, an N-th Inclusive-OR gate performs an Inclusive-OR operation on values of the N-th bit and a first bit stored in the first register, an N-th First NOR gate performs an NOR operation on outputs of the (N−1)-th Inclusive-OR gate and the N-th Inclusive-OR gate, a first NOR gate performs an NOR operation on outputs of the N-th Inclusive-OR gate and the first Inclusive-OR gate, so as to obtain the intermediate value;

N is a natural number greater than or equal to 2.

Optionally, the second logic circuit comprises N numbers of First NOT gates and N numbers of Second AND gates;

wherein an N-th First NOT gate performs an NOT operation on each bit of the intermediate value;

an N-th Second AND gate performs an AND operation on an output of the N-th First NOT gate and an initial value of an N-th bit as correspondingly stored in the initial value register, to obtain the first correction value;

the third logic circuit comprises N numbers of Third AND gates;

an N-th Third AND gate performs an AND operation on the intermediate value and a value of an N-th bit as correspondingly stored in the first register, so as to obtain the second correction value;

the fourth logic circuit comprises N numbers of First OR gates;

an N-th First OR gate performs an OR operation on outputs of the N-th Second AND gate and the N-th Third AND gate;

N is a natural number greater than or equal to 2.

Optionally, the second logic circuit comprises N numbers of Second OR gates;

an N-th Second OR gate performs an OR operation on the intermediate value and an initial value of an N-th bit as correspondingly stored in the initial value register;

the third logic circuit comprises N numbers of Second NOT gates and N numbers of Third OR gates;

an N-th Second NOT gate performs an NOT operation on each bit of the intermediate value;

an N-th Third OR gate performs an OR operation on an output of an N-th Second NOT gate and a value of an N-th bit as stored in the first register;

the fourth logic circuit comprises N numbers of Fourth AND gates;

an N-th Fourth AND performs an AND operation on outputs of the N-th Second OR gate and the N-th Third OR gate;

N is a natural number greater than or equal to 2.

Optionally, the repairing system for a CABC module further comprises a detection module and a counting module;

the detection module being configured to detect whether an N-th bit in the first register is abnormal;

the counting module being configured to obtain a total number of bits that are abnormal in the first register;

wherein if no abnormal bit appears in the first register, outputs of bits in the first register are regarded as inputs of bits corresponding thereto in the second register;

if a plurality of abnormal bits appear in the first register, the CABC module is closed.

In a third aspect, an embodiment of the present disclosure provides a repairing method for a CABC module, comprising:

performing a logic operation on a check value of a bit stored in a first register so as to obtain an intermediate value, so that a value corresponding to an abnormal bit in the first register as contained in the intermediate value is different than a value corresponding to a normal bit;

performing a logic operation on the intermediate value and an initial value of a corresponding bit in an initial register so as to obtain a first correction value, a value corresponding to an abnormal bit as contained in the first correction value being equal to a value corresponding to an abnormal bit as contained in the initial value;

performing a logic operation on the intermediate value after an NOT logic operation and an initial value of a corresponding bit in the first register so as to obtain a second correction value, a value corresponding to a normal bit as contained in the second correction value being equal to a value corresponding to a normal bit as contained in the initial value; and performing a logic operation on the first correction value and the second correction value, so as to obtain a result which would have been obtained by inputting an initial value into the first register having no failure, as an input of the second register.

In a fourth aspect, an embodiment of the present disclosure provides a repairing method for a CABC module, comprising:

performing a logic operation on a check value of a bit stored in a first register so as to obtain an intermediate value, so that a value corresponding to an abnormal bit in the first register as contained in the intermediate value is different than a value corresponding to a normal bit;

performing a logic operation on the intermediate value after an NOT logic operation and an initial value of a corresponding bit in an initial register so as to obtain a first correction value, a value corresponding to an abnormal bit as contained in the first correction value being equal to a value corresponding to an abnormal bit as contained in the initial value;

performing a logic operation on the intermediate value and an initial value of a corresponding bit in the first register so as to obtain a second correction value, a value corresponding to a normal bit as contained in the second correction value being equal to a value corresponding to a normal bit as contained in the initial value; and performing a logic operation on the first correction value and the second correction value, so as to obtain a result which would have been obtained by inputting an initial value into the first register having no failure, as an input of the second register.

In the repairing system and repairing method for a CABC module provided by the embodiments of the present disclosure, a binary number for differentiating a normal bit and an abnormal bit in the first register is obtained by the first logic circuit; the first correction value corresponding to an initial value of an abnormal bit in the first register is obtained and retained by the second logic circuit; and an initial value corresponding to a normal bit in the first register is obtained and retained by the third logic circuit; and through the operation performed by the fourth logic circuit on the first correction value and the second correction value, a result which would have been obtained by inputting an initial value into the first register having no failure is obtained as an input of the second register. Repairing of the abnormal first register is implemented. In addition, since the input of the second register is a result which would have been obtained by inputting an initial value into the first register having no failure, thus it is possible to accurately control a duty cycle of the PWM waveform outputted by the CABC module.

BRIEF DESCRIPTION OF THE DRAWINGS

In order to more clearly illustrate the technical solutions in the embodiments of the present disclosure or the technical solutions in the prior art, drawings necessary for describing the embodiments or the prior art will be briefly introduced below, obviously, the following drawings are parts of embodiments of the present disclosure, and for those of ordinary skill in the art, it is possible to attain other drawings based on these drawings without paying creative effort.

DETAILED DESCRIPTION OF THE EMBODIMENTS

To make the objects, technical solutions, and advantages of the present disclosure be more clear and obvious, hereinafter, the technical solutions in the embodiments of the present disclosure will be described clearly and comprehensively in combination with the drawings thereof, obviously, these described embodiments are parts of the embodiments of the present disclosure, rather than all of the embodiments thereof. All the other embodiments obtained by those of ordinary skill in the art based on the embodiments of the present disclosure without paying creative efforts fall into the protection scope of the present disclosure.

First Embodiment

Figure 1:
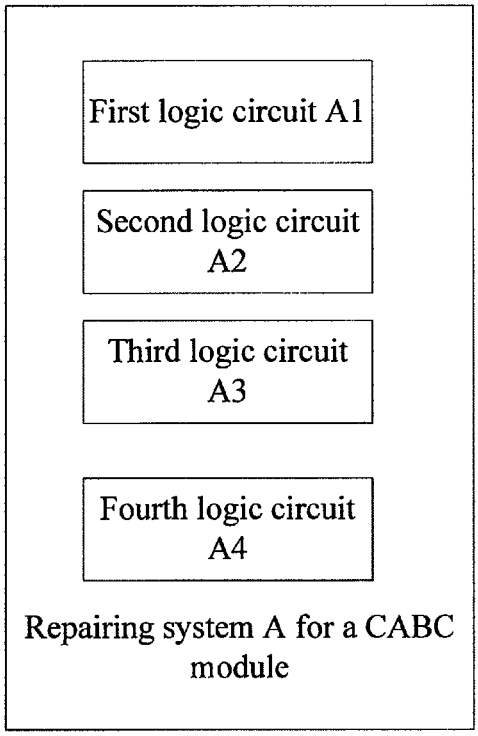
FIG. 1 is a schematic diagram of structure of a repairing system for a CABC module provided by an embodiment of present disclosure.

FIG. 1 is a schematic diagram of structure of a repairing system for a CABC module provided by an embodiment of present disclosure, referring to FIG. 1, a repairing system A for a CABC module comprises a CABC module, a first logic circuit A1, a second logic circuit A2, a third logic circuit A3, and a fourth logic circuit A4.

The CABC module further includes a first register, a second register, and an initial value register. The initial value register is configured to input a check value or an initial value to the first register.

The first logic circuit A1 performs logic operation on a check value of a bit stored in the first register so as to obtain an intermediate value, so that a value corresponding to an abnormal bit in the first register as contained in the intermediate value is different than a value corresponding to a normal bit.

The second logic circuit A2 performs logic operation on the intermediate value and an initial value of a corresponding bit in the initial register so as to obtain a first correction value, a value corresponding to an abnormal bit as contained in the first correction value is equal to a value corresponding to an abnormal bit as contained in the initial value.

The third logic circuit A3 performs logic operation on the intermediate value after an NOT logic operation and an initial value of a corresponding bit in the first register so as to obtain a second correction value, a value corresponding to a normal bit as contained in the second correction value is equal to a value corresponding to a normal bit as contained in the initial value.

The fourth logic circuit A4 performs logic operation on the first correction value and the second correction value, so as to obtain a result which would have been obtained by inputting an initial value into the first register having no failure, as an input of the second register, to control a duty cycle of the PWM waveform outputted by the CABC module.

It should be noted that, the check value may be a set of binary code in which 1 and 0 appear alternately. The check value is inputted to the first register having an abnormal bit, after a binary code outputted by the first register passes through the logic operation performed by the first logic circuit A1, in an obtained binary code, a value corresponding to an abnormal bit in the first register is different than a value corresponding to a normal bit, this binary code serves as an intermediate value.

For example, a second bit among 8 bits in the first register is abnormal, an output of this abnormal bit is the same as an output of an adjacent bit (the output of the abnormal bit usually is 1 or 0). As for the check value 10101010, an output of the first register is 11101010.

The first logic circuit A1 first performs an Exclusive-NOR operation on the output 11101010, and then performs an AND operation thereon. The first logic circuit A1 performs an Exclusive-NOR operation on outputs of adjacent bits in the first register, performs an Exclusive-NOR operation on values of a last bit and a first bit as a last bit of an operation result, an obtained result is 11000000. Then, the first logic circuit A1 performs an AND operation on the result of the Exclusive-NOR operation, the AND operation is performed on adjacent bits, a result obtaining from performing the AND operation on values of a first bit and a last bit in the result 11000000 is regarded as a first bit of an operation result, an obtained result is 01000000, which is the intermediate value.

A value corresponding to an abnormal bit in the first register as contained in the intermediate value is different than a value corresponding to a normal bit, for example, the intermediate value 01000000 shows that the abnormal bit in the first register is the second bit.

The second logic circuit A2 performs a logic operation on the intermediate value and corresponding bits in an inputted initial value so as to obtain a first correction value, a value corresponding to an abnormal bit as contained in the first correction value is equal to a value corresponding to an abnormal bit as contained in the initial value, for example, the inputted initial value is 01001001, an AND operation is performed on the initial value 01001001 and the corresponding bits of the intermediate value 01000000, an obtained result is 01000000, in this result, a binary value corresponding to an abnormal bit in the first register as contained in the initial value is retained, binary values of other bits in the initial value change into 0.

After the third logic circuit A3 performs an NOT operation on the intermediate value, the third logic circuit A3 performs an AND operation on bits of the NOT-operated intermediate value and the output of the first register or the initial value in the initial value register. For example, after the intermediate value is NOT-operated, the result is 10111111, after the AND operation is performed on said result and 01001001, an obtained result is 00001001, that is, values of bits corresponding to normal bits in the first register as contained in the initial value are retained.

The fourth logic circuit A4 performs an OR operation on corresponding bits of results of the second logic circuit A2 and the third logic circuit A3, an obtained result is the same as the initial value. For example, a result obtained by performing an OR operation on corresponding bits of 01000000 and 00001001 is 01001001.

If the above described repairing system for a CABC module is not adopted, the value outputted from the first register is 00001001, since the second bit of the first register is abnormal, 1 in the second bit in the initial value changes into 0 in the second bit in this result.

By means of the repairing system for a CABC module provided by this embodiment o, a register having one abnormal bit (or having multiple abnormal bits, but there are at least two normal bits spaced between the multiple abnormal bits) can be repaired, so that the abnormal shift register can output a binary code the same as the inputted initial value, repairing of the shift register having an abnormal bit is implemented.

Second Embodiment

In the repairing system for a CABC module provided by this embodiment, the first logic circuit comprises N numbers of Exclusive-NOR gates and N numbers of First AND gates, wherein an (N−1)-th Exclusive-NOR gate performs an Exclusive-NOR operation on check values of an N-th bit and an (N−1)-th bit stored in the first register, an N-th Exclusive-NOR gate performs an Exclusive-NOR operation on values of the N-th bit and a first bit stored in the first register, an N-th First AND gate performs an AND operation on outputs of the (N−1)-th Exclusive-NOR gate and the N-th Exclusive-NOR gate, a first First AND gate performs an AND operation on outputs of the N-th Exclusive-NOR gate and a first Exclusive-NOR gate, so as to obtain the intermediate value;

N is a natural number larger than or equal to 2.

Figure 2:
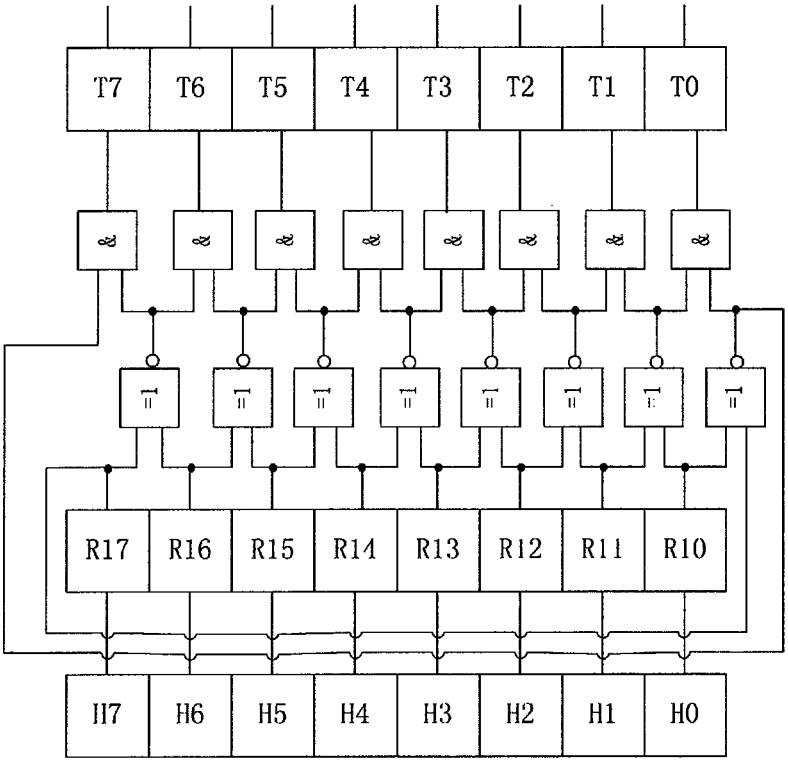
FIG. 2 is a schematic diagram of a first logic circuit of a repairing system for a CABC module provided by an embodiment of present disclosure.

FIG. 2 is a schematic diagram of a first logic circuit of a repairing system for a CABC module provided by an embodiment of present disclosure, referring to FIG. 2, the first logic circuit comprises 8 Exclusive-NOR gates and 8 First AND gates H0-H7 are 8 bits in the initial register, R10-R17 are 8 bits in the first register, T0-T7 are registers for storing the intermediate value. The check value 10101010 or 01010101 is inputted into the initial value register or directly inputted into 8 bits of the first register, an Exclusive-NOR operation is performed on outputs of a first bit R17 and a second bit R16 in the first register to output a first bit value, an Exclusive-NOR operation is performed on outputs of the second bit R16 and a third bit R15 in the first register to output a second bit value, an Exclusive-NOR operation is performed on outputs of the third bit R15 and a fourth bit R14 in the first register to output a third bit value, and so on and so fourth, an Exclusive-NOR operation is performed on outputs of the last bit R10 and the first bit R17 in the first register to output an eighth bit value, and obtained result is 11000000.

An output obtained after performing an AND operation on the eighth bit value and the first bit value in the result obtained from the Exclusive-NOR operation is regarded as a value of a first bit T7 of the intermediate value; an output obtained after performing an AND operation on the first bit value and the second bit value is regarded as a value of a second bit T6 of the intermediate value; an output obtained after performing an AND operation on the second bit value and the third bit value is regarded as a value of a third bit T5 of the intermediate value, and so on and so fourth, a binary code of the intermediate value is obtained, for example, a result obtained after performing said operation on 11000000 is 01000000.

The repairing system for a CABC module provided by this embodiment implements a first logic operation through a combination of Exclusive-NOR gates and AND gates.

Third Embodiment

This embodiment provides another circuit that implements the first logic operation, the first logic circuit comprises N numbers of Inclusive-OR gates and N numbers of First AND gates, wherein an (N−1)-th Inclusive-OR gate performs an Inclusive-OR operation on check values of an N-th bit and an (N−1)-th bit stored in the first register, an N-th Inclusive-OR gate performs an Inclusive-OR operation on values of the N-th bit and a first bit stored in the first register, an N-th First AND gate performs an AND operation on outputs of the (N−1)-th Inclusive-OR gate and the N-th Inclusive-OR gate, a first First AND gate performs an AND operation on outputs of the N-th Inclusive-OR gate and a first Inclusive-OR gate, so as to obtain the intermediate value;

N is a natural number greater than or equal to 2.

In comparison to the first logic circuit in the Second Embodiment, in the first logic circuit provided by this embodiment, the Exclusive-NOR gates are replaced with the Inclusive-OR gates, the entire circuit is an equivalent alternative for the circuit in the Second Embodiment.

Fourth Embodiment

This embodiment provides another circuit that implements the first logic operation, the first logic circuit comprises N numbers of XOR gates and N numbers of NOR gates, wherein an (N−1)-th XOR gate performs an XOR operation on check values of an N-th bit and an (N−1)-th bit stored in the first register, an N-th XOR gate performs an XOR operation on values of the N-th bit and a first bit stored in the first register, an N-th NOR gate performs an NOR operation on outputs of the (N−1)-th XOR gate and the N-th XOR gate, a first NOR gate performs an NOR operation on outputs of the N-th XOR gate and a first XOR gate, so as to obtain the intermediate value;

N is a natural number greater than or equal to 2.

In comparison to the first logic circuit in the Second Embodiment, in the first logic circuit provided by this embodiment, the Exclusive-NOR gates are replaced with the Exclusive-OR (XOR) gates, the entire circuit is an equivalent alternative for the circuit in the Second Embodiment.

Fifth Embodiment

This embodiment provides a second logic circuit, the second logic circuit comprises N numbers of Second AND gates;

an N-th Second AND gate performs an AND operation on the intermediate value and an initial value of an N-th bit as correspondingly stored in the initial value register, to obtain the first correction value;

the third logic circuit comprises N numbers of First NOT gates and N numbers of Third AND gates;

an N-th First NOT gate performs an NOT operation on each bit of the intermediate value;

an N-th Third AND gate performs all AND operation on an output of an N-th First NOT gate and a value of an N-th bit as stored in the first register, so as to obtain the second correction value;

the fourth logic circuit comprises N numbers of OR gates;

an N-th OR gate performs an OR operation on outputs of the N-th Second AND gate and the N-th Third AND gate;

N is a natural number greater than or equal to 2.

Figure 3:
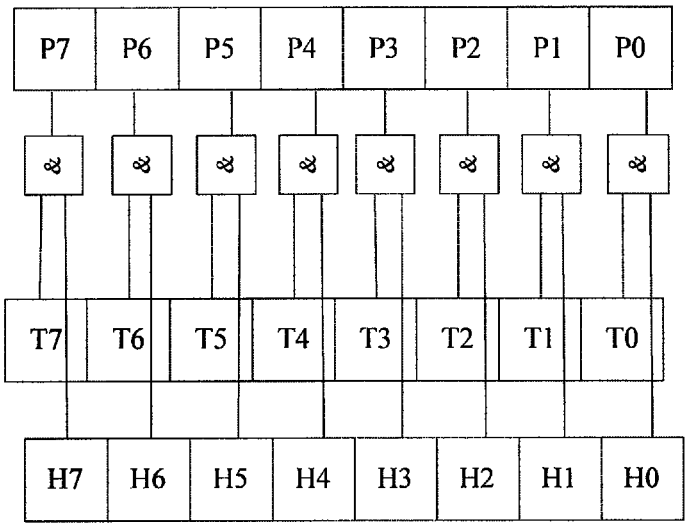
FIG. 3 is a schematic diagram of a second logic circuit of a repairing system for a CABC module provided by an embodiment of present disclosure.

FIG. 3 is a schematic diagram of a second logic circuit of a repairing system for a CABC module provided by an embodiment of present disclosure, as shown in FIG. 3, H0-H7 are 8 bits in the initial register, T0-T7 are 8 bits in the intermediate value, and P0-P7 are 8 bits in the first correction value. An AND operation is performed on the intermediate value and an initial value as correspondingly stored in bits of the initial value register, for example, an AND operation is performed on an initial value in a first bit H7 in the initial value register and a first bit T7 of the intermediate, an obtained result is regarded as a value in a first bit of the first correction value.

For example, an AND operation is performed on the initial value 01001001 and values in corresponding bits of the intermediate 01000000, the obtained first correction value is 01000000.

Figure 4:
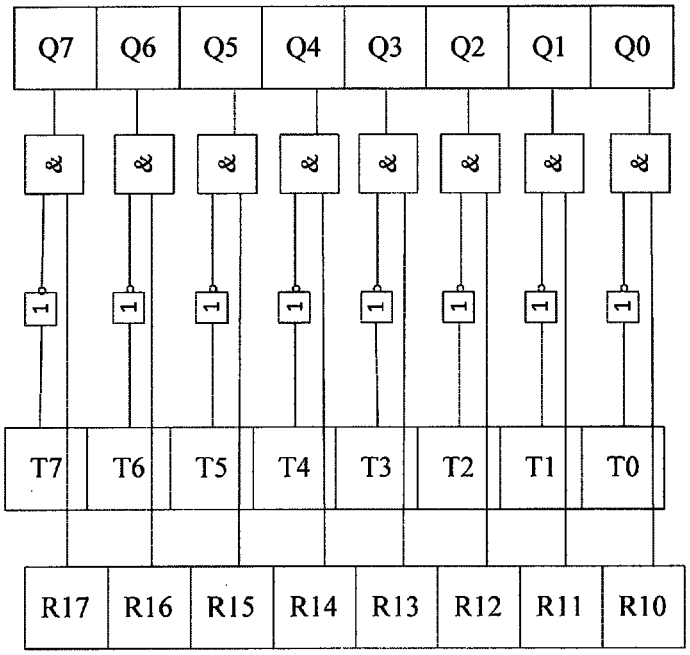
FIG. 4 is a schematic diagram of a third logic circuit of a repairing system for a CABC module provided by an embodiment of present disclosure.

FIG. 4 is a circuit diagram of a third logic circuit of a repairing system for a CABC module provided by an embodiment of present disclosure, as shown in FIG. 4, R10-R17 are 8 bits in the first register, T0-T7 are 8 bits of the intermediate value, Q0-Q7 are 8 bits of the second correction value. After an NOT operation is performed on the value in each bit of the intermediate value, an AND operation is further performed on an obtained result and the corresponding bits of the initial value, to obtain the second correction value.

For example, a result obtained after performing an NOT operation on the intermediate value is 10111111, and a result obtained by performing an AND operation on the result 10111111 and the initial value (00001001) outputted by the first register or corresponding bits of the initial value (01001001) is the second correction value 00001001.

Figure 5:
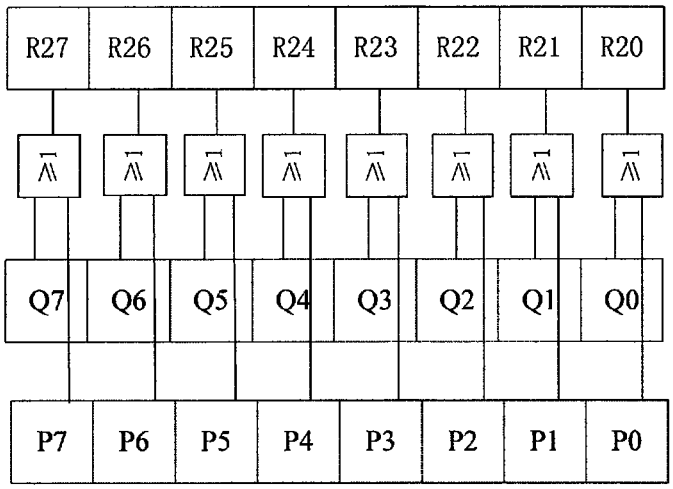
FIG. 5 is a schematic diagram of a fourth logic circuit of a repairing system for a CABC module provided by an embodiment of present disclosure.

FIG. 5 is a circuit diagram of a fourth logic circuit of a repairing system for a CABC module provided by an embodiment of present disclosure, as shown in FIG. 5, P0-P7 are 8 bits of the first correction value, Q0-Q7 are 8 bits of the second correction value, R20-27 are 8 bits of the second register, a result obtained by performing an OR operation on corresponding bits of the first correction value and the second correction value is inputted to the second register.

For example, a result obtained by performing an OR operation on the corresponding bits of the first correction value 01000000 and the second correction value 00001001 is 01001001.

Figure 6:
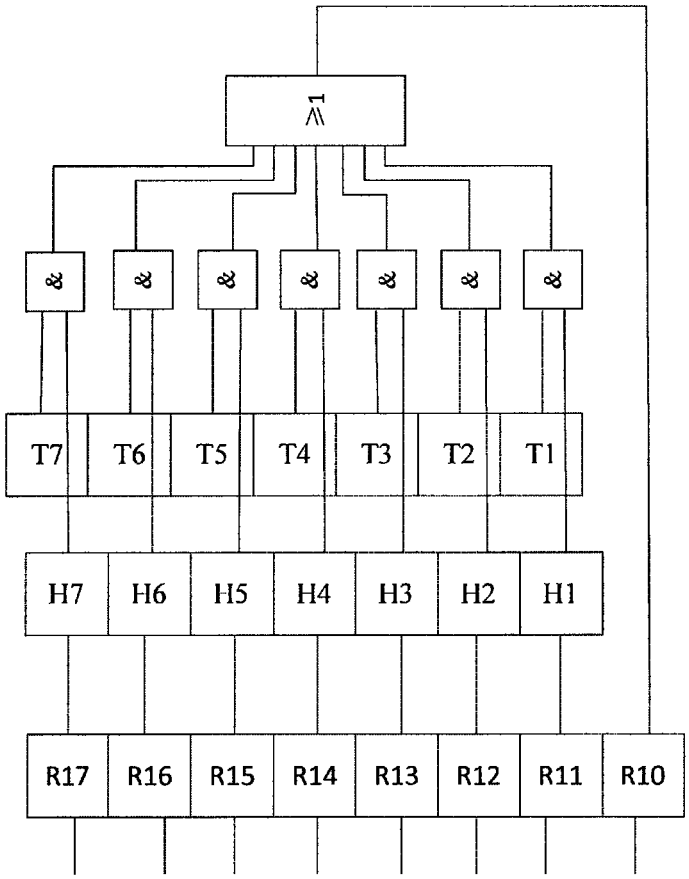
FIG. 6 is a schematic diagram of a second logic circuit of a repairing system for a CABC module provided by another embodiment of present disclosure.
Figure 7:
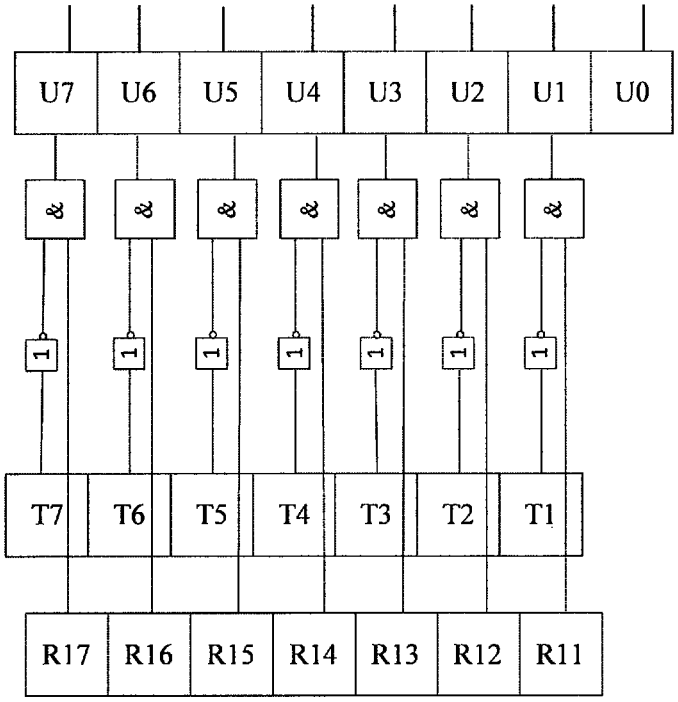
FIG. 7 is a schematic diagram of a third logic circuit of a repairing system for a CABC module provided by another embodiment of present disclosure.
Figure 8:
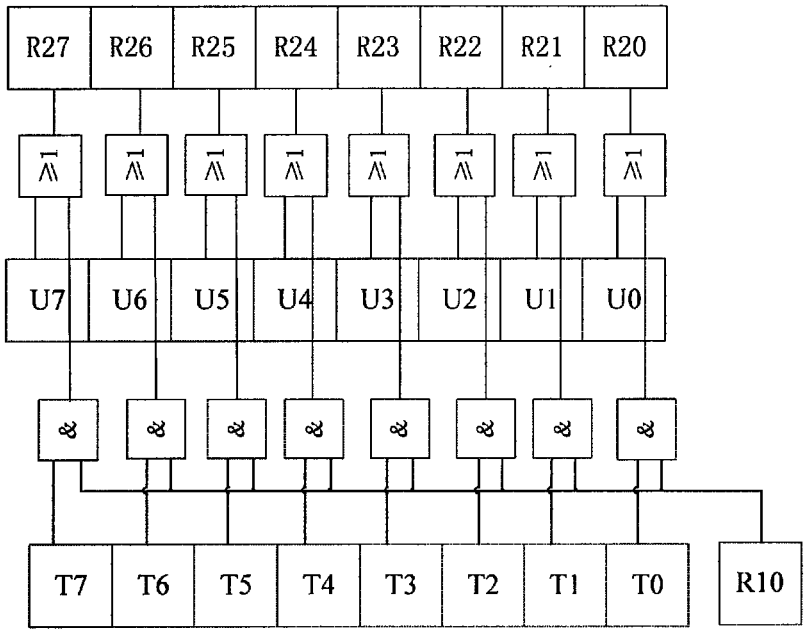
FIG. 8 is a schematic diagram of a fourth logic circuit of a repairing system for a CABC module provided by another embodiment of present disclosure.

Repairing of the CABC module can also be implemented by adopting the second logic circuit in FIG. 6, the third logic circuit in FIG. 7, and the fourth logic circuit in FIG. 8, just like the first logic circuit in FIG. 2.

In comparison to the second logic circuit in FIG. 3, the second logic circuit in FIG. 6 extracts the binary code corresponding to an abnormal bit in the initial value, after the logic operation performed by the OR gates, it is stored into the eighth bit R10 in the first register. This method performs a logic operation only on the first 7 bits in the first register, a result extracted from an abnormal bit is stored in the bit R10 in first register, in comparison to the second logic circuit in FIG. 3, this method saves storage space.

In comparison to the third logic circuit in FIG. 4, the third logic circuit in FIG. 7 performs a logic operation only on the first 7 bits (R17-R11) in the first register an obtained result is stored in 7 bits U1-U7.

The fourth logic circuit in FIG. 8 performs an OR operation on a result, which is obtained by performing an AND operation on each bit of the intermediate value and a binary code extracted from a binary code corresponding to an abnormal bit in the initial value, and the result stored in 8 bits U0-U7, an outputted result is a corrected result, and will be written into corresponding bits R20-R27 in the second register.

It should be noted that, for convenience of explanation, some memories (e.g., P0-P7 in FIG. 3 and FIG. 5; Q0-Q7 in FIG. 4 and FIG. 5; FIG. 7 or 8 U0-U7 in FIG. 7 and FIG. 8) are introduced in the drawings, in an actual circuit, an output of one circuit can be directly used as an input of another circuit.

In the repairing system for a CABC module provided by this embodiment, with regard to an intermediate value whose bits corresponding to a normal bit in the first register are 0 and whose bits corresponding to an abnormal bit therein are 1, the first correction value whose bits corresponding to a normal bit in the first register are 0 is obtained by the second logic circuit, the second correction value whose bits corresponding to an abnormal bit are the first register is 0 is obtained by the third logic circuit; an OR operation is performed on the first correction value and the second correction value by the fourth logic circuit, so as to obtain a result which would have been obtained by inputting an initial value into the first register having no failure, as an input of the second register.

Sixth Embodiment

This embodiment provides a second logic circuit comprising N numbers of Second NOT gates and N numbers of Second OR gates;

an N-th Second NOT gate performs an NOT operation on each bit of the intermediate value;

an N-th Second OR gate performs an OR operation on an output of the N-th Second NOT gate and an initial value of an N-th bit as correspondingly stored in the initial value register;

the third logic circuit comprises N numbers of Third OR gates;

an N-th Third OR gate performs an OR operation on the intermediate value and a value of an N-th bit as correspondingly stored in the first register;

the fourth logic circuit comprises N numbers of Fourth AND gates;

an N-th Fourth AND gate performs an AND operation on outputs of the N-th Second OR gate and the N-th Third AND gate;

wherein N is a natural number greater than or equal to 2.

In the repairing system for a CABC module provided in this embodiment, a combination of the second logic circuit, the third logic circuit, and the fourth logic circuit is an equivalent alternative for a combination of the logic circuit, the third logic circuit, and the fourth logic circuit in the second embodiment.

In the repairing system for a CABC module provided by this embodiment, with regard to an intermediate value whose bits corresponding to a normal bit in the first register are 0 and whose bits corresponding to an abnormal bit therein are 1, the first correction value whose bits corresponding to a normal bit in the first register are 1 is obtained by the second logic circuit, the second correction value whose bits corresponding to an abnormal bit are the first register is 1 is obtained by the third logic circuit; an AND operation is performed on the first correction value and the second correction value by the fourth logic circuit, so as to obtain a result which would have been obtained by inputting an initial value into the first register having no failure, as an input of the second register.

Seventh Embodiment

The repairing system for a CABC module provided by an embodiment of the present disclosure further comprises a detection module and a counting module based on any of the repairing system for a CABC module provided in the First Embodiment to the Sixth Embodiment;

the detection module is configured to detect whether an N-th bit in the first register is abnormal;

the counting module is configured to obtain a total number of bits that are abnormal in the first register;

if no abnormal bit appears in the first register, outputs of bits in the first register are regarded as inputs of bits corresponding thereto in the second register;

if a plurality of abnormal bits appear in the first register, the repairing system for a CABC module is closed.

In the repairing system for a CABC module provided in this embodiment, if no abnormal bit appears in the first register, values in the first register are directly inputted to the second register; if a plurality of abnormal bits appear in the first register, the CABC module is closed. Since the repairing system for a CABC module provided by the First Embodiment to the Sixth Embodiment repairs a register having one abnormal bit (or having multiple abnormal bits, but there are at least two normal bits spaced between the multiple abnormal bits), first, detection of an abnormal bit is performed on the first register, thereafter, a proper circuit is selected according to a detection result, so as to improve efficiency that the first register stores the binary code into the corresponding bits in the second register.

Eighth Embodiment

This embodiment provides a repairing system for a CABC module, said repairing system comprising:

a CABC module that includes a first register and a second register;

an initial value register configured to input a check value or an initial value to the first register;

a first logic circuit configured to perform a logic operation on a check value of a bit stored in the first register so as to obtain an intermediate value, so that a value corresponding to an abnormal bit in the first register as contained in the intermediate value is different than a value corresponding to a normal bit;

a second logic circuit configured to perform a logic operation on the intermediate value after an NOT logic operation and an initial value of a corresponding bit in the initial register so as to obtain a first correction value, a value corresponding to an abnormal bit as contained in the first correction value being equal to a value corresponding to an abnormal bit as contained in the initial value;

a third logic circuit configured to perform a logic operation on the intermediate value and an initial value of a corresponding bit in the first register so as to obtain a second correction value, a value corresponding to a normal bit as contained in the second correction value being equal to a value corresponding to a normal bit as contained in the initial value; and a fourth logic circuit configured to perform a logic operation on the first correction value and the second correction value, so as to obtain a result which would have been obtained by inputting an initial value into the first register having no failure, as an input of the second register.

This embodiment provides another implementation mode corresponding to the First Embodiment, the difference lies in that in the intermediate value obtained by the first logic circuit in this embodiment, a value to which an abnormal bit corresponds is equal to a value to which a normal bit corresponds in the First Embodiment.

Ninth Embodiment

In the repairing system for a CABC module provided in this embodiment, the first logic circuit comprises N numbers of Inclusive-NOR gates and N numbers of First AND gates, an (N−1)-th Inclusive-NOR gate performs an Inclusive-NOR operation on check values of an N-th bit and an (N−1)-th bit stored in the first register, an N-th Inclusive-NOR gate performs an Inclusive-NOR operation on values of the N-th bit and a first bit stored in the first register, an N-th First AND gate performs an AND operation on outputs of the (N−1)-th Inclusive-NOR gate and the N-th Exclusive-NOR gate, a first First AND gate performs an AND operation on outputs of the N-th Inclusive-NOR gate and a first Inclusive-NOR gate, so as to obtain the intermediate value;

N is a natural number larger than or equal to 2.

In the repairing system for a CABC module provided in this embodiment, a binary value for differentiating a normal bit and an abnormal bit in the first register is obtained by the first logic circuit composed by Inclusive-NOR gates and AND gates.

Tenth Embodiment

In the repairing system for a CABC module provided in this embodiment, the first logic circuit comprises N numbers of XOR gates and N numbers of First OR gates, wherein an (N−1)-th XOR gate performs an XOR operation on check values of an N-th bit and an (N−1)-th bit stored in the first register, an N-th XOR gate performs an XOR operation on values of the N-th bit and a first bit stored in the first register, an N-th First OR gate performs an OR operation on outputs of the (N−1)-th XOR gate and the N-th XOR gate, a first First OR gate performs an OR operation on outputs of the N-th XOR gate and the first XOR gate, so as to obtain the intermediate value;

N is a natural number greater than or equal to 2.

In the repairing system for a CABC module provided in this embodiment, a binary number for differentiating a normal bit and an abnormal bit in the first register is obtained by the first logic circuit composed by XOR gates and OR gates.

Eleventh Embodiment

In the repairing system for a CABC module provided in this embodiment, the first logic circuit comprises N numbers of Inclusive-OR gates and N numbers of NOR gates, an (N−1)-th Inclusive-OR gate performs an Inclusive-OR operation on check values of an N-th bit and an (N−1)-th bit stored in the first register, an N-th Inclusive-OR gate performs an Inclusive-OR operation on values of the N-th bit and a first bit stored in the first register, an N-th NOR gate performs an NOR operation on outputs of the (N−1)-th Inclusive-OR gate and the N-th Inclusive-OR gate, a first NOR gate performs an NOR operation on outputs of the N-th Inclusive-OR gate and the first Inclusive-OR gate, so as to obtain the intermediate value;

N is a natural number greater than or equal to 2.

In the repairing system for a CABC module provided in this embodiment, a binary number for differentiating a normal bit and an abnormal bit in the first register is obtained by the first logic circuit composed by Inclusive-OR gates and NOR gates.

Twelfth Embodiment

In the repairing system for a CABC module provided in this embodiment, the second logic circuit comprises N numbers of First NOT gates and N numbers of Second AND gates;

an N-th First NOT gate performs an NOT operation on each bit of the intermediate value;

an N-th Second AND gate performs an AND operation on an output of the N-th First NOT gate and an initial value of an N-th bit as correspondingly stored in the initial value register, to obtain the first correction value;

the third logic circuit comprises N numbers of Third AND gates;

an N-th Third AND gate performs an AND operation on the intermediate value and a value of an N-th bit as correspondingly stored in the first register, so as to obtain the second correction value;

the fourth logic circuit comprises N numbers of First OR gates;

an N-th First OR gate performs an OR operation on outputs of an N-th Second AND gate and an N-th Third AND gate;

N is a natural number greater than or equal to 2.

In the repairing system for a CABC module provided by this embodiment, with regard to an intermediate value whose bits corresponding to a normal bit in the first register are 1 and whose bits corresponding to an abnormal bit therein are 0, the first correction value whose bits corresponding to a normal bit in the first register are 0 is obtained by the second logic circuit, the second correction value whose bits corresponding to an abnormal bit are the first register is 0 is obtained by the third logic circuit; an OR operation is performed on the first correction value and the second correction value by the fourth logic circuit, so as to obtain a result which would have been obtained by inputting an initial value into the first register having no failure, as an input of the second register.

Thirteenth Embodiment

In the repairing system for a CABC module provided in this embodiment, the second logic circuit comprises N numbers of Second OR gates;

an N-th Second OR gate performs an OR operation on the intermediate value and an initial value of an N-th bit as correspondingly stored in the initial value register;

the third logic circuit comprises N numbers of Second NOT gates and N numbers of Third OR gates;

an N-th Second NOT gate performs an NOT operation on each bit of the intermediate value;

an N-th Third OR gate performs an OR operation on an output of an N-th Second NOT gate and a value of an N-th bit as stored in the first register;

the fourth logic circuit comprises N numbers of Fourth AND gates;

an N-th Fourth AND performs an AND operation on outputs of the N-th Second OR gate and the N-th Third OR gate;

N is a natural number greater than or equal to 2.

In the repairing system for a CABC module provided by this embodiment, with regard to an intermediate value whose bits corresponding to a normal bit in the first register are 0 and whose bits corresponding to an abnormal bit therein are 1, the first correction value whose bits corresponding to a normal bit in the first register are 1 is obtained by the second logic circuit, the second correction value whose bits corresponding to an abnormal bit are the first register is 1 is obtained by the third logic circuit; an AND operation is performed on the first correction value and the second correction value by the fourth logic circuit, so as to obtain a result which would have been obtained by inputting an initial value into the first register having no failure, as an input of the second register.

Fourteenth Embodiment

The repairing system for a CABC module provided by this embodiment further comprises a detection module and a counting module;

the detection module is configured to detect whether an N-th bit in the first register is abnormal;

the counting module is configured to obtain a total number of bits that are abnormal in the first register;

wherein if no abnormal bit appears in the first register, outputs of bits in the first register are regarded as inputs of bits corresponding thereto in the second register;

if a plurality of abnormal bits appear in the first register, the repairing system for a CABC module is closed.

As for the CABC module in the Eighth Embodiment to the Thirteenth Embodiment, if no abnormal bit appears in the first register, values in the first register are directly inputted to the second register; if a plurality of abnormal bits appear in the first register, the CABC module is closed.

Fifth Embodiment

Figure 9:
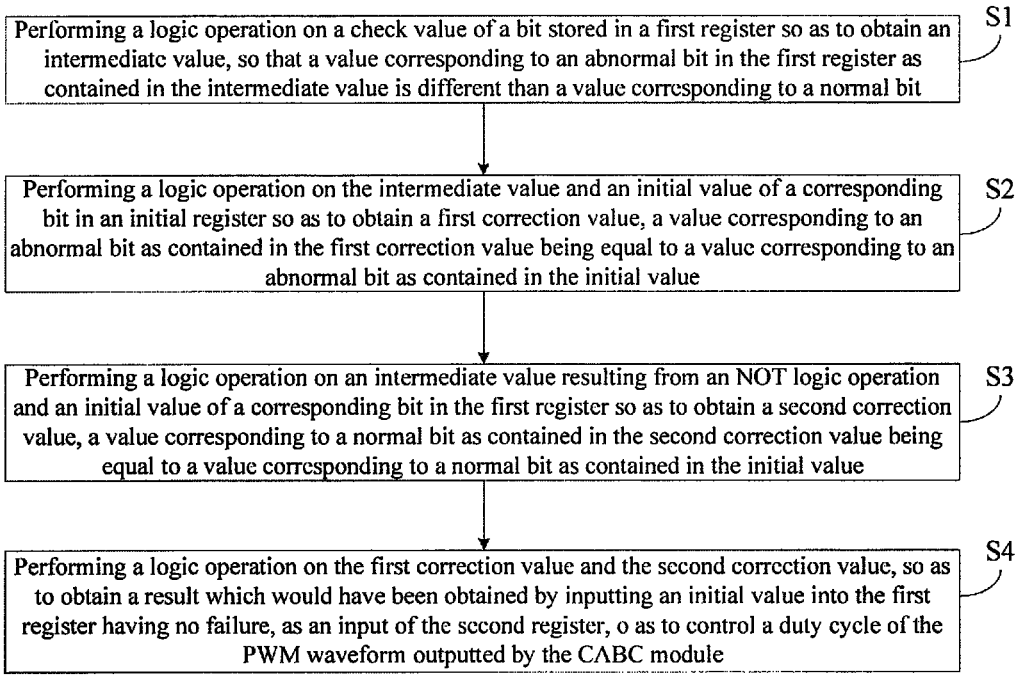
FIG. 9 is a flowchart of a repairing method for a CABC module provided by an embodiment of present disclosure.

FIG. 9 is a flowchart of a repairing method for a CABC module provided by this embodiment, referring to FIG. 9, the repairing method for a CABC module comprises:

S1: performing a logic operation on a check value of a bit stored in a first register so as to obtain an intermediate value, so that a value corresponding to an abnormal bit in the first register as contained in the intermediate value is different than a value corresponding to a normal bit;

S2: performing a logic operation on the intermediate value and an initial value of a corresponding bit in an initial register so as to obtain a first correction value, a value corresponding to an abnormal bit as contained in the first correction value being equal to a value corresponding to an abnormal bit as contained in the initial value;

S3: performing a logic operation on the intermediate value after an NOT logic operation and an initial value of a corresponding bit in the first register so as to obtain a second correction value, a value corresponding to a normal bit as contained in the second correction value being equal to a value corresponding to a normal bit as contained in the initial value; and

S4: performing a logic operation on the first correction value and the second correction value, so as to obtain a result which would have been obtained by inputting an initial value into the first register having no failure, as an input of the second register.

The repairing method for a CABC module provided by this embodiment corresponds to the repairing system for a CABC module provided by the First Embodiment.

Sixteenth Embodiment

Figure 10:
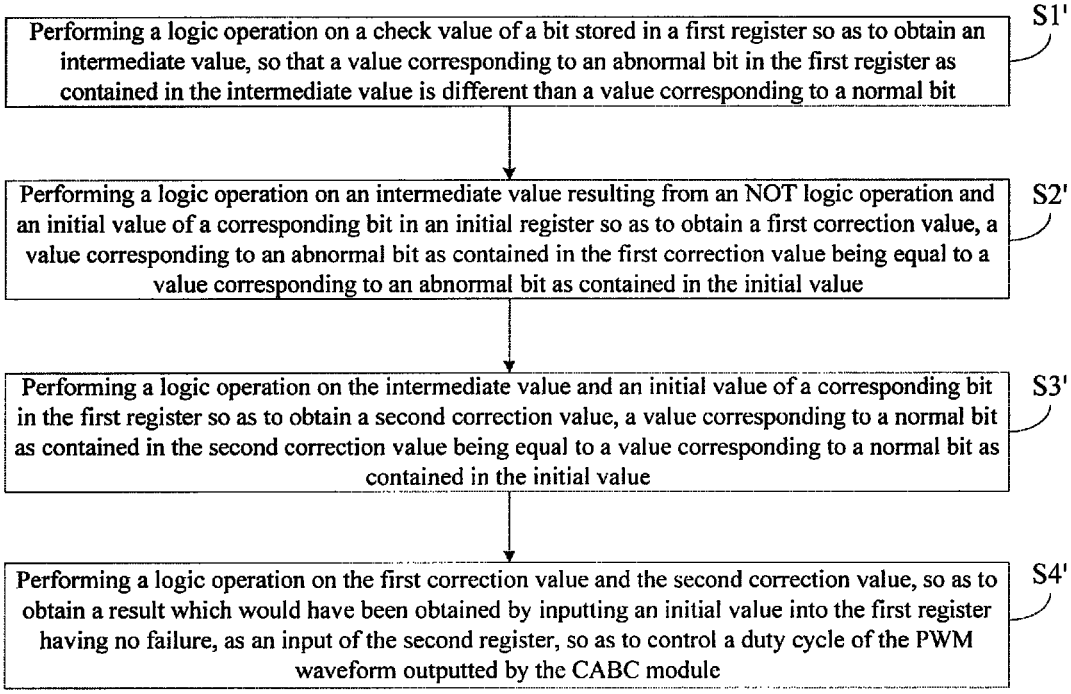
FIG. 10 is a flowchart of a repairing method for a CABC module provided by another embodiment of present disclosure.

FIG. 10 is a flowchart of a repairing method for a CABC module provided by another embodiment of present disclosure. Referring to FIG. 10, the repairing method for a CABC module comprises:

S1': performing a logic operation on a check value of a bit stored in a first register so as to obtain an intermediate value, so that a value corresponding to an abnormal bit in the first register as contained in the intermediate value is different than a value corresponding to a normal bit;

S2': performing a logic operation on the intermediate value after an NOT logic operation and an initial value of a corresponding bit in an initial register so as to obtain a first correction value, a value corresponding to an abnormal bit as contained in the first correction value being equal to a value corresponding to an abnormal bit as contained in the initial value;

S3': performing a logic operation on the intermediate value and an initial value of a corresponding bit in the first register so as to obtain a second correction value, a value corresponding to a normal bit as contained in the second correction value being equal to a value corresponding to a normal bit as contained in the initial value; and

S4': performing a logic operation on the first correction value and the second correction value, so as to obtain a result which would have been obtained by inputting an initial value into the first register having no failure, as an input of the second register.

The repairing method for a CABC module provided by this embodiment corresponds to the repairing system for a CABC module provided by the Eighth Embodiment.

Seventeenth Embodiment

Figure 11:
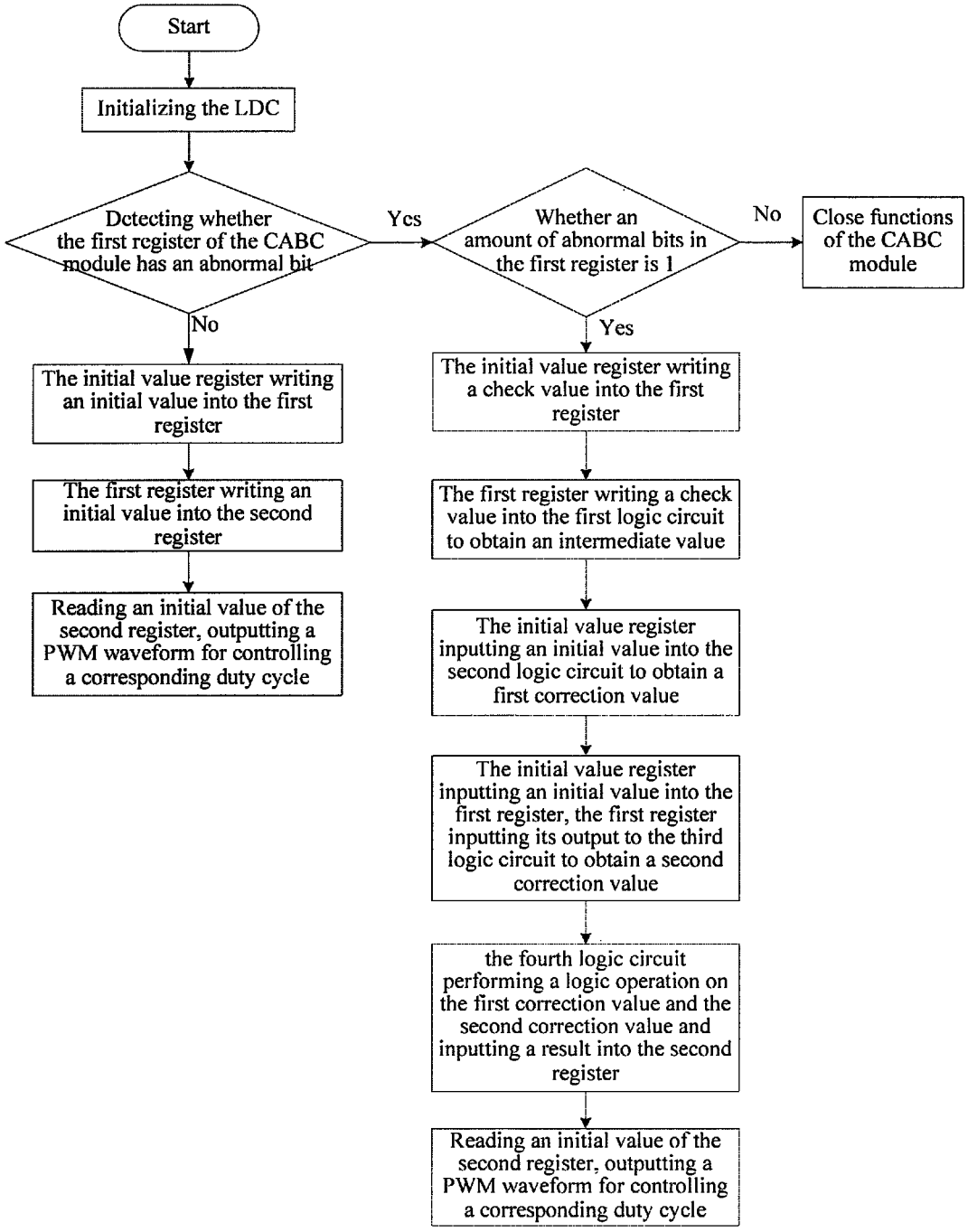
FIG. 11 is a flowchart of a repairing method for a CABC module provided by another embodiment of present disclosure.

FIG. 11 is a flowchart of a repairing method for a CABC module provided by this embodiment, referring to FIG. 11, after a liquid crystal display (LCD) is initiated, whether the CABC module has abnormality is detected by the detection module, if the answer is positive, then it is further determined how many abnormal bits exist in the CABC module (alternatively, abnormal bits of the CABC module and specific locations of the abnormal bits are determined by the first logic circuit provided by the embodiments of the present disclosure).

If the CABC module has no abnormal bits, in order to save time, an output of the first register is no more repaired by the repairing system for a CABC module provided by the embodiments of the present disclosure. The initial value is directly written into the first register, the first register writes its output into the second register, so as to control a duty cycle of the PWM waveform outputted by the CABC module. If the CABC module has abnormal bits, then it needs to detect the amount of the abnormal bits in particular, if there is only one abnormal bit (or there are multiple abnormal bits, but there are at least two normal bits spaced between the multiple abnormal bits), then the repairing system for a CABC module provided by this embodiment is adopted, to repair an output of the first register having an abnormal bit. If the amount of the abnormal bits in the first register is relatively large, then the function of the CABC module is closed.

If there is only one abnormal bit in the first register, an intermediate value is first obtained by the first logic circuit, specifically, the intermediate value is obtained by inputting a check value to the initial value register and through the logic operation performed by the first logic circuit.

Thereafter, an initial value is inputted to the initial value register, the initial value and the intermediate value pass through the second logic circuit so that a first correction value is obtained, the initial value and the intermediate value outputted by the first register pass through the logic operation performed by the third logic circuit so that a second correction value is obtained, a logic operation is performed by the fourth logic circuit on the first correction value and the second correction value to obtain a repaired value, this repaired value is inputted to the second register, so as to control a duty cycle of the PWM waveform.

The repairing system for a CABC module provided by this embodiment selects a proper method to control a numeric value written by the first register into the second register according to a different situation of bit abnormality appearing in the first register, operation efficiency of the CABC module is improved while ensuring that the first register in which very few bit is abnormal is repaired.

The above described are only preferred embodiments of the present disclosure, they are not intended to limit the present disclosure, and for those skilled in the art, the present disclosure may have various modifications and variations. Any modification, equivalent replacement, or improvement made within the spirits and principles of the present disclosure should fall into the scope of the present disclosure.

What is claimed is:

1. A repairing system for a Content Adaptive Backlight Control (CABC) module, said repairing system comprising:

a CABC module that includes a first register and a second register;

an initial value register configured to input a check value or an initial value to the first register;

a first logic circuit configured to perform a logic operation on a check value of a bit stored in the first register so as to obtain an intermediate value, so that a value corresponding to an abnormal bit in the first register as contained in the intermediate value is different than a value corresponding to a normal bit;

a second logic circuit configured to perform a logic operation on the intermediate value and an initial value of a corresponding bit in the initial register so as to obtain a first correction value, a value corresponding to an abnormal bit as contained in the first correction value being equal to a value corresponding to an abnormal bit as contained in the initial value;

a third logic circuit configured to perform a logic operation on the intermediate value after an NOT logic operation and an initial value of a corresponding bit in the first register so as to obtain a second correction value, a value corresponding to a normal bit as contained in the second correction value being equal to a value corresponding to a normal bit as contained in the initial value; and a fourth logic circuit configured to perform a logic operation on the first correction value and the second correction value, so as to obtain a result which would have been obtained by inputting the initial value into the first register having no failure, as an input of the second register.

2. The repairing system for a CABC module according to claim 1, wherein the first logic circuit comprises N numbers of Exclusive-NOR gates and N numbers of First AND gates, an (N−1)-th Exclusive-NOR gate performs an Exclusive-NOR operation on check values of an N-th bit and an (N−1)-th bit stored in the first register, an N-th Exclusive-NOR gate performs an Exclusive-NOR operation on check values of the N-th bit and a first bit stored in the first register, an N-th First AND gate performs an AND operation on outputs of the (N−1)-th Exclusive-NOR gate and the N-th Exclusive-NOR gate, a first First AND gate performs an AND operation on outputs of the N-th Exclusive-NOR gate and a first Exclusive-NOR gate, so as to obtain the intermediate value;

N is a natural number larger than or equal to 2.

3. The repairing system for a CABC module according to claim 1, wherein the first logic circuit comprises N numbers of Inclusive-OR gates and N numbers of First AND gates, an (N−1)-th Inclusive-OR gate performs an Inclusive-OR operation on check values of an N-th bit and an (N−1)-th bit stored in the first register, an N-th Inclusive-OR gate performs an Inclusive-OR operation on values of the N-th bit and a first bit stored in the first register, an N-th First AND gate performs an AND operation on outputs of the (N−1)-th Inclusive-OR gate and the N-th Inclusive-OR gate, a first First AND gate performs an AND operation on outputs of the N-th Inclusive-OR gate and a first Inclusive-OR gate, so as to obtain the intermediate value;

N is a natural number greater than or equal to 2.

4. The repairing system for a CABC module according to claim 1, wherein the first logic circuit comprises N numbers of XOR gates and N numbers of NOR gates, an (N−1)-th XOR gate performs an XOR operation on check values of an N-th bit and an (N−1)-th bit stored in the first register, an N-th XOR gate performs an XOR operation on values of the N-th bit and a first bit stored in the first register, an N-th NOR gate performs an NOR operation on outputs of the (N−1)-th XOR gate and the N-th XOR gate, a first NOR gate performs an NOR operation on outputs of the N-th XOR gate and a first XOR gate, so as to obtain the intermediate value;

N is a natural number greater than or equal to 2.

5. The repairing system for a CABC module according to claim 1, wherein the second logic circuit comprises N numbers of Second AND gates;

an N-th Second AND gate performs an AND operation on the intermediate value and an initial value of an N-th bit as correspondingly stored in the initial value register, to obtain the first correction value;

the third logic circuit comprises N numbers of First NOT gates and N numbers of Third AND gates;

an N-th First NOT gate performs an NOT operation on each bit of the intermediate value;

an N-th Third AND gate performs an AND operation on an output of an N-th First NOT gate and a value of an N-th bit as stored in the first register, so as to obtain the second correction value;

the fourth logic circuit comprises N numbers of OR gates;

an N-th OR gate performs an OR operation on outputs of the N-th Second AND gate and the N-th Third AND gate;

N is a natural number greater than or equal to 2.

6. The repairing system for a CABC module according to claim 1, further comprising a detection module and a counting module;

the detection module being configured to detect whether an N-th bit in the first register is abnormal;

the counting module being configured to obtain a total number of bits that are abnormal in the first register;

wherein if no abnormal bit appears in the first register, outputs of bits in the first register are regarded as inputs of bits corresponding thereto in the second register;

if a plurality of abnormal bits appear in the first register, the CABC module is closed.

7. A repairing system for a Content Adaptive Backlight Control (CABC) module, said repairing system comprising:

a CABC module that includes a first register and a second register;

an initial value register configured to input a check value or an initial value to the first register;

a first logic circuit configured to perform a logic operation on a check value of a bit stored in the first register so as to obtain an intermediate value, so that a value corresponding to an abnormal bit in the first register as contained in the intermediate value is different than a value corresponding to a normal bit;

a second logic circuit configured to perform a logic operation on the intermediate value after an NOT logic operation and an initial value of a corresponding bit in the initial register so as to obtain a first correction value, a value corresponding to an abnormal bit as contained in the first correction value being equal to a value corresponding to an abnormal bit as contained in the initial value;

a third logic circuit configured to perform a logic operation on the intermediate value and an initial value of a corresponding bit in the first register so as to obtain a second correction value, a value corresponding to a normal bit as contained in the second correction value being equal to a value corresponding to a normal bit as contained in the initial value; and a fourth logic circuit configured to perform a logic operation on the first correction value and the second correction value, so as to obtain a result which would have been obtained by inputting the initial value into the first register having no failure, as an input of the second register.

8. The repairing system for a CABC module according to claim 7, wherein the first logic circuit comprises N numbers of Inclusive-NOR gates and N numbers of First AND gates, an (N−1)-th Inclusive-NOR gate performs an Inclusive-NOR operation on check values of an N-th bit and an (N−1)-th bit stored in the first register, an N-th Inclusive-NOR gate performs an Inclusive-NOR operation on check values of the N-th bit and a first bit stored in the first register, an N-th First AND gate performs an AND operation on outputs of the (N−1)-th Inclusive-NOR gate and the N-th Exclusive-NOR gate, a first First AND gate performs an AND operation on outputs of the N-th Inclusive-NOR gate and a first Inclusive-NOR gate, so as to obtain the intermediate value;

N is a natural number larger than or equal to 2.

9. The repairing system for a CABC module according to claim 7, wherein the first logic circuit comprises N numbers of XOR gates and N numbers of First OR gates, an (N−1)-th XOR gate performs an XOR operation on check values of an N-th bit and an (N−1)-th bit stored in the first register, an N-th XOR gate performs an XOR operation on values of the N-th bit and a first bit stored in the first register, an N-th First OR gate performs an OR operation on outputs of the (N−1)-th XOR gate and the N-th XOR gate, a first First OR gate performs an OR operation on outputs of the N-th XOR gate and a first XOR gate, so as to obtain the intermediate value;

N is a natural number greater than or equal to 2.

10. The repairing system for a CABC module according to claim 7, wherein the first logic circuit comprises N numbers of Inclusive-OR gates and N numbers of First NOR gates, an (N−1)-th Inclusive-OR gate performs an Inclusive-OR operation on check values of an N-th bit and an (N−1)-th bit stored in the first register, an N-th Inclusive-OR gate performs an Inclusive-OR operation on values of the N-th bit and a first bit stored in the first register, an N-th First NOR gate performs an NOR operation on outputs of the (N−1)-th Inclusive-OR gate and the N-th Inclusive-OR gate, a first NOR gate performs an NOR operation on outputs of the N-th Inclusive-OR gate and the first Inclusive-OR gate, so as to obtain the intermediate value;

N is a natural number greater than or equal to 2.

11. The repairing system for a CABC module according to claim 7, wherein the second logic circuit comprises N numbers of First NOT gates and N numbers of Second AND gates;

an N-th First NOT gate performs an NOT operation on each bit of the intermediate value;

an N-th Second AND gate performs an AND operation on an output of the N-th First NOT gates and an initial value of an N-th bit as correspondingly stored in the initial value register, to obtain the first correction value;

the third logic circuit comprises N numbers of Third AND gates;

an N-th Third AND gate performs an AND operation on the intermediate value and a value of an N-th bit as correspondingly stored in the first register, so as to obtain the second correction value;

the fourth logic circuit comprises N numbers of First OR gates;

an N-th First OR gate performs an OR operation on outputs of the N-th Second AND gate and the N-th Third AND gate;

N is a natural number greater than or equal to 2.

12. The repairing system for a CABC module according to claim 7, further comprising a detection module and a counting module;

the detection module being configured to detect whether an N-th bit in the first register is abnormal;

the counting module being configured to obtain a total number of bits that are abnormal in the first register;

wherein if no abnormal bit appears in the first register, outputs of bits in the first register are regarded as inputs of bits corresponding thereto in the second register;

if a plurality of abnormal bits appear in the first register, the CABC module is closed.

13. A repairing method for a Content Adaptive Backlight Control (CABC) module, comprising:

performing, by a first logic circuit, a logic operation on a check value of a bit stored in a first register so as to obtain an intermediate value, so that a value corresponding to an abnormal bit in the first register as contained in the intermediate value is different than a value corresponding to a normal bit;

performing, by a second logic circuit, a logic operation on the intermediate value and an initial value of a corresponding bit in an initial register so as to obtain a first correction value, a value corresponding to an abnormal bit as contained in the first correction value being equal to a value corresponding to an abnormal bit as contained in the initial value;

performing, by a third logic circuit, a logic operation on the intermediate value after an NOT logic operation and an initial value of a corresponding bit in the first register so as to obtain a second correction value, a value corresponding to a normal bit as contained in the second correction value being equal to a value corresponding to a normal bit as contained in the initial value; and performing, by a fourth logic circuit, a logic operation on the first correction value and the second correction value, so as to obtain a result which would have been obtained by inputting the initial value into the first register having no failure, as an input of the second register.

14. A repairing method for a Content Adaptive Backlight Control (CABC) module, comprising:

performing, by a first logic circuit, a logic operation on a check value of a bit stored in a first register so as to obtain an intermediate value, so that a value corresponding to an abnormal bit in the first register as contained in the intermediate value is different than a value corresponding to a normal bit;

performing, by a second logic circuit, a logic operation on the intermediate value after an NOT logic operation and an initial value of a corresponding bit in an initial register so as to obtain a first correction value, a value corresponding to an abnormal bit as contained in the first correction value being equal to a value corresponding to an abnormal bit as contained in the initial value;

performing, by a third logic circuit, a logic operation on the intermediate value and an initial value of a corresponding bit in the first register so as to obtain a second correction value, a value corresponding to a normal bit as contained in the second correction value being equal to a value corresponding to a normal bit as contained in the initial value; and performing, by a fourth logic circuit, a logic operation on the first correction value and the second correction value, so as to obtain a result which would have been obtained by inputting the initial value into the first register having no failure, as an input of the second register.

* * * * *